US008523529B2

(12) United States Patent
Brittingham

(10) Patent No.: US 8,523,529 B2
(45) Date of Patent: Sep. 3, 2013

(54) LOCKING SPACER ASSEMBLY FOR A CIRCUMFERENTIAL ENTRY AIRFOIL ATTACHMENT SYSTEM

(75) Inventor: Robert Alan Brittingham, Piedmont, SC (US)

(73) Assignee: General Electric Company, Schenectady, NY (US)

( * ) Notice: Subject to any disclaimer, the term of this patent is extended or adjusted under 35 U.S.C. 154(b) by 966 days.

(21) Appl. No.: 12/616,320

(22) Filed: Nov. 11, 2009

(65) Prior Publication Data

US 2011/0110782 A1 May 12, 2011

(51) Int. Cl.
*F01D 5/32* (2006.01)

(52) U.S. Cl.
USPC ..... 416/215; 416/220 R

(58) Field of Classification Search
USPC ..... 416/225, 217, 220 R
See application file for complete search history.

(56) References Cited

U.S. PATENT DOCUMENTS

| | | | | |
|---|---|---|---|---|
| 2,421,855 | A * | 6/1947 | Soderberg | 416/217 |
| 3,627,448 | A | 12/1971 | Rupp et al. | |
| 4,818,182 | A | 4/1989 | Bouru | |
| 4,859,149 | A | 8/1989 | McClain | |
| H1258 | H | 12/1993 | Hindle, Jr. | |
| 6,135,717 | A | 10/2000 | Sokol et al. | |
| 6,290,464 | B1 | 9/2001 | Negulescu et al. | |
| 6,638,006 | B2 | 10/2003 | Selby | |
| 6,647,602 | B2 * | 11/2003 | Bachofner et al. | 29/23.51 |
| 6,752,598 | B2 * | 6/2004 | Antunes et al. | 416/215 |
| 6,929,453 | B2 * | 8/2005 | Kite et al. | 416/220 R |
| 6,981,847 | B2 | 1/2006 | Arinci et al. | |
| 7,168,919 | B2 | 1/2007 | Blatchford et al. | |
| 7,435,055 | B2 * | 10/2008 | Hansen et al. | 416/215 |
| 7,581,931 | B2 * | 9/2009 | Shaefer et al. | 416/198 A |
| 2001/0022936 | A1 | 9/2001 | Zimmermamm | |
| 2004/0037703 | A1 | 2/2004 | Arinci et al. | |
| 2005/0226729 | A1 | 10/2005 | Negulescu et al. | |
| 2006/0222502 | A1 | 10/2006 | Hansen et al. | |
| 2007/0297908 | A1 | 12/2007 | Barber | |
| 2009/0016889 | A1 * | 1/2009 | Krutzfeldt et al. | 416/204 R |
| 2009/0220345 | A1 * | 9/2009 | Krutzfeldt et al. | 416/220 R |

FOREIGN PATENT DOCUMENTS

| | | |
|---|---|---|
| EP | 1321630 | 6/2003 |
| WO | WO 01/96711 | 12/2001 |
| WO | WO 2007077185 A1 * | 7/2007 |
| WO | WO 2008/013610 | 1/2008 |
| WO | WO 2008/037550 | 4/2008 |
| WO | WO 2008/049677 | 5/2008 |

OTHER PUBLICATIONS

English Abstract of WO2001096711.

* cited by examiner

*Primary Examiner* — Nathaniel Wiehe
*Assistant Examiner* — Sean J Younger
(74) *Attorney, Agent, or Firm* — Dority & Manning, P.A.

(57) ABSTRACT

A locking spacer assembly for insertion in a circumferential attachment slot includes a first end piece and a second end piece. The first and second end pieces each comprise an outer surface and an inner surface, the inner surfaces generally facing towards each other when the end pieces are inserted into the attachment slot. An actuator is movable between the inner surfaces and a spacer block is configured to be inserted between the inner surfaces. A fastener is configured to secure the spacer block to the actuator. The actuator is configured to engage the inner surfaces such that the end pieces move toward each other and lock the assembly within the attachment slot.

18 Claims, 5 Drawing Sheets

LOCKING SPACER ASSEMBLY FOR A CIRCUMFERENTIAL ENTRY AIRFOIL ATTACHMENT SYSTEM

FIELD OF THE INVENTION

The present subject matter relates generally to circumferential entry airfoil attachment systems and, more particularly, to a locking spacer assembly for use in such a system.

BACKGROUND OF THE INVENTION

A conventional gas turbine includes a rotor with various rotor blades and turbine buckets mounted to discs in the compressor and turbine sections thereof. Each blade or bucket includes an airfoil over which pressurized air or fluid flows, and a platform at the base of the airfoil that defines the radially inner boundary for the air or fluid flow. The blades and buckets are typically removable, and therefore include a suitable root, such as a T-type root, configured to engage a complementary attachment slot in the perimeter of the disc. The roots may either be axial-entry roots or circumferential-entry roots that engage corresponding axial or circumferential slots formed in the disc perimeter. A typical root includes a neck of minimum cross sectional area and protrusions extending from the root into a pair of lateral recesses located within the attachment slot.

For circumferential roots, a single attachment slot is formed between forward and aft continuous circumferential posts and extends circumferentially around the entire perimeter of the disc. The cross-sectional shape of the circumferential attachment slot includes lateral recesses defined by forward and aft rotor disc posts that cooperate with the root protrusions to radially retain the individual blades or buckets against centrifugal force during turbine operation.

In the compressor section of a gas turbine, for example, rotor blades (specifically the root component) are inserted into and around the circumferential slot and rotated approximately ninety degrees to bring the root protrusions into contact with the lateral recesses to define a complete stage of rotor blades around the circumference of the rotor discs. The blades include platforms at the airfoil base that may be in abutting engagement around the slot. In other embodiments, spacers may be installed in the circumferential slot between adjacent compressor blade platforms. Once all of the blades (and spacers) have been installed, a final remaining space(s) in the slot is typically filled with a specifically designed spacer assembly, as generally known in the art.

A common technique used to facilitate the insertion of the final spacer assembly into the circumferential slot is to include a non-axi symmetric loading slot in the rotor disc. However, loading slots are costly to manufacture and the inclusion of such a slot creates a location of high stress. Various conventional spacer assemblies have been designed to eliminate the need for a loading slot in a rotor disc but include complicated multi-component devices. These conventional assemblies are generally difficult to assemble, and are prone to coming apart during operation of the turbine, for example, if either side of the device develops clearance relative to adjacent components (i.e., the rotor discs or platforms). Accordingly, there is a need for a final spacer assembly that it relatively easy to assemble within the final space between platforms of adjacent airfoils of rotor blades or turbine buckets located within a circumferential entry attachment slot.

BRIEF DESCRIPTION OF THE INVENTION

Aspects and advantages of the present subject matter will be set forth in part in the following description, or may be obvious from the description, or may be learned through practice of the present subject matter.

In one aspect, the present subject matter provides a unique locking spacer assembly for use in a circumferential attachment slot between platforms of adjacent airfoils. The assembly includes two end pieces configured to fit into a space between the platforms, with each end piece comprising an outer surface and an inner surface. An actuator is movable between the inner surfaces and a spacer bock is configured to be inserted between the inner surfaces. The spacer block includes a cavity configured to receive the actuator. A fastener is also included and is configured to secure the spacer block to the actuator. Finally, the actuator is configured to engage the inner surfaces such that the end pieces move toward each other and lock the assembly within the attachment slot.

In another aspect, the present subject matter encompasses a rotor assembly having a rotor with a rotor disc. Forward and aft post components of the disc define a continuous circumferentially extending attachment slot. The rotor assembly also includes a plurality of airfoils, with each airfoil extending from a platform. Each platform is secured to the attachment slot by an inwardly extending root. A locking spacer assembly is installed in a space between at least two of the platforms. The locking spacer assembly may be configured as discussed above and described in greater detail herein.

These and other features, aspects and advantages of the present subject matter will become better understood with reference to the following description and appended claims. The accompanying drawings, which are incorporated in and constitute a part of this specification, illustrate embodiments of the invention and, together with the description, serve to explain the principles of the present subject matter.

BRIEF DESCRIPTION OF THE DRAWINGS

A full and enabling disclosure of the present subject matter, including the best mode thereof, directed to one of ordinary skill in the art, is set forth in the specification, which makes reference to the appended figures, in which.

DETAILED DESCRIPTION OF THE INVENTION

Figure 1:
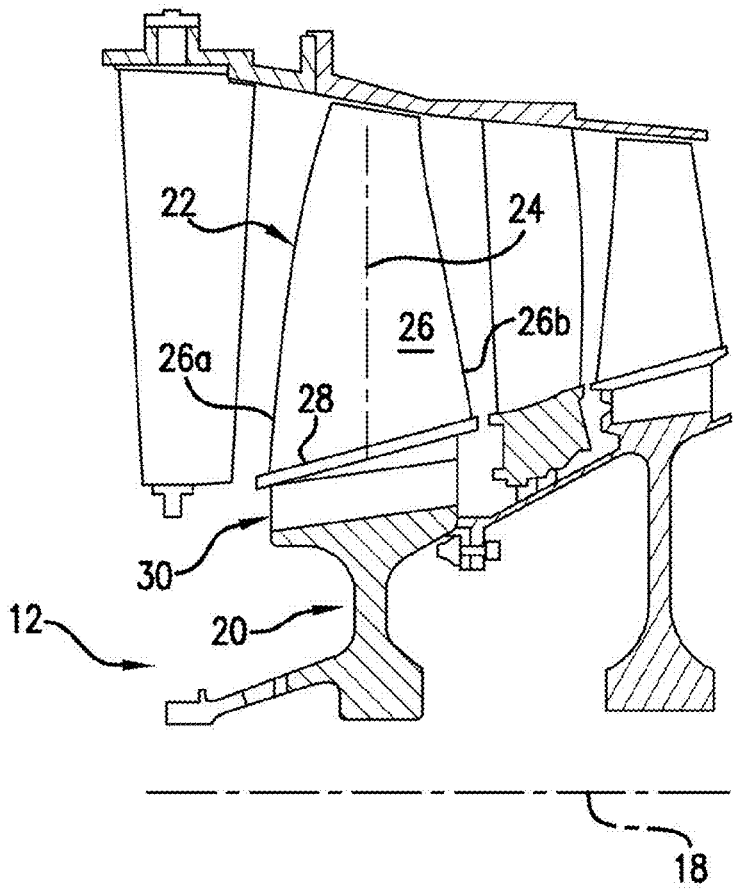
FIG. 1 provides a partial sectional view of components in a compressor section of a conventional gas turbine configuration.

Reference now will be made in detail to embodiments of the present subject matter, one or more examples of which are illustrated in the drawings. Each example is provided by way of explanation of the present subject matter, not limitation. In fact, it will be apparent to those skilled in the art that various modifications and variations can be made in the present subject matter without departing from the scope or spirit of the present subject matter. For instance, features illustrated or described as part of one embodiment, can be used with another embodiment to yield a still further embodiment. Thus, it is intended that the present invention covers such modifications and variations as come within the scope of the appended claims and their equivalents.

Several components in a compressor section of a conventional gas turbine are illustrated, for example, in FIG. 1 wherein a rotor 12 includes a plurality of rotor discs 20 disposed coaxially with the centerline axis 18 of the turbine. A plurality of circumferentially spaced rotor blades 22 is removably fixed to the disc and extends radially outward therefrom. Each blade 22 has a longitudinal centerline axis 24 and includes an airfoil section 26 having a leading edge 26*a* and a trailing edge 26*b* (in the direction of airflow over the blade 22). Additionally, each blade 22 has a platform 28 that provides a portion of the radially inner boundary for the airflow over the airfoils 26, and an integral root 30 that extends radially inward from the platform 28. The root 30 slides into and along a circumferentially extending attachment slot defined by forward and aft post components 34 (FIG. 2) of the rotor disc 20, as is generally known in the art.

Figure 2:
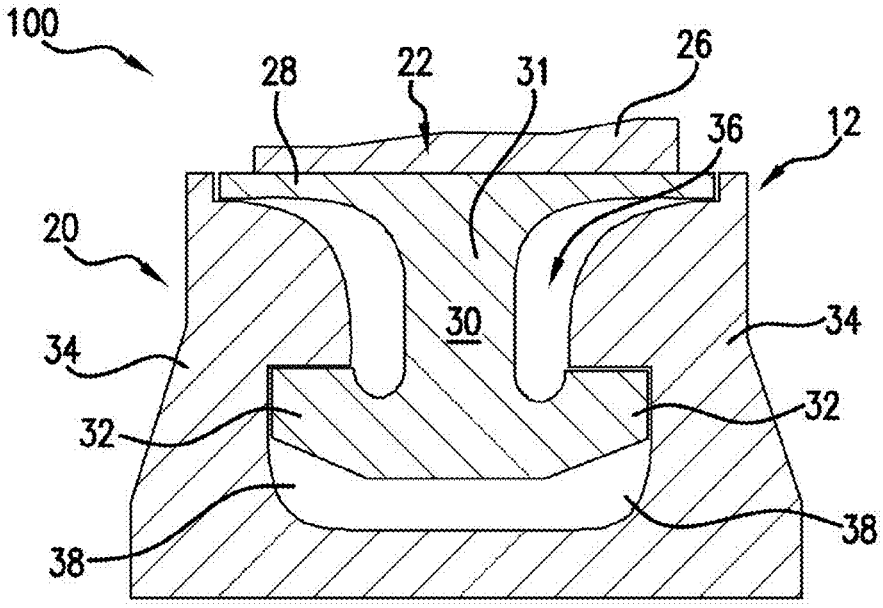
FIG. 2 provides a partial sectional view of an embodiment of a root and attachment slot configuration for circumferential entry rotor blades.

FIG. 2 is a more detailed view of an embodiment of a T-type root and attachment slot configuration. The rotor blade 22 includes a platform 28 with an integrally formed root 30 extending therefrom into the attachment slot 36 defined by facing walls of forward and aft posts 34 of the rotor disc 20. The root 30 includes protrusions 32 that are received into lateral recesses 38 in the attachment slot 30 defined by recessed portions of the post walls. It should be readily appreciated that the configuration of the root 30 and attachment slot 36 in FIG. 2 is for illustrative purposes only, and that the root and slot configuration may vary widely within the scope and spirit of the present subject matter.

Figure 3:
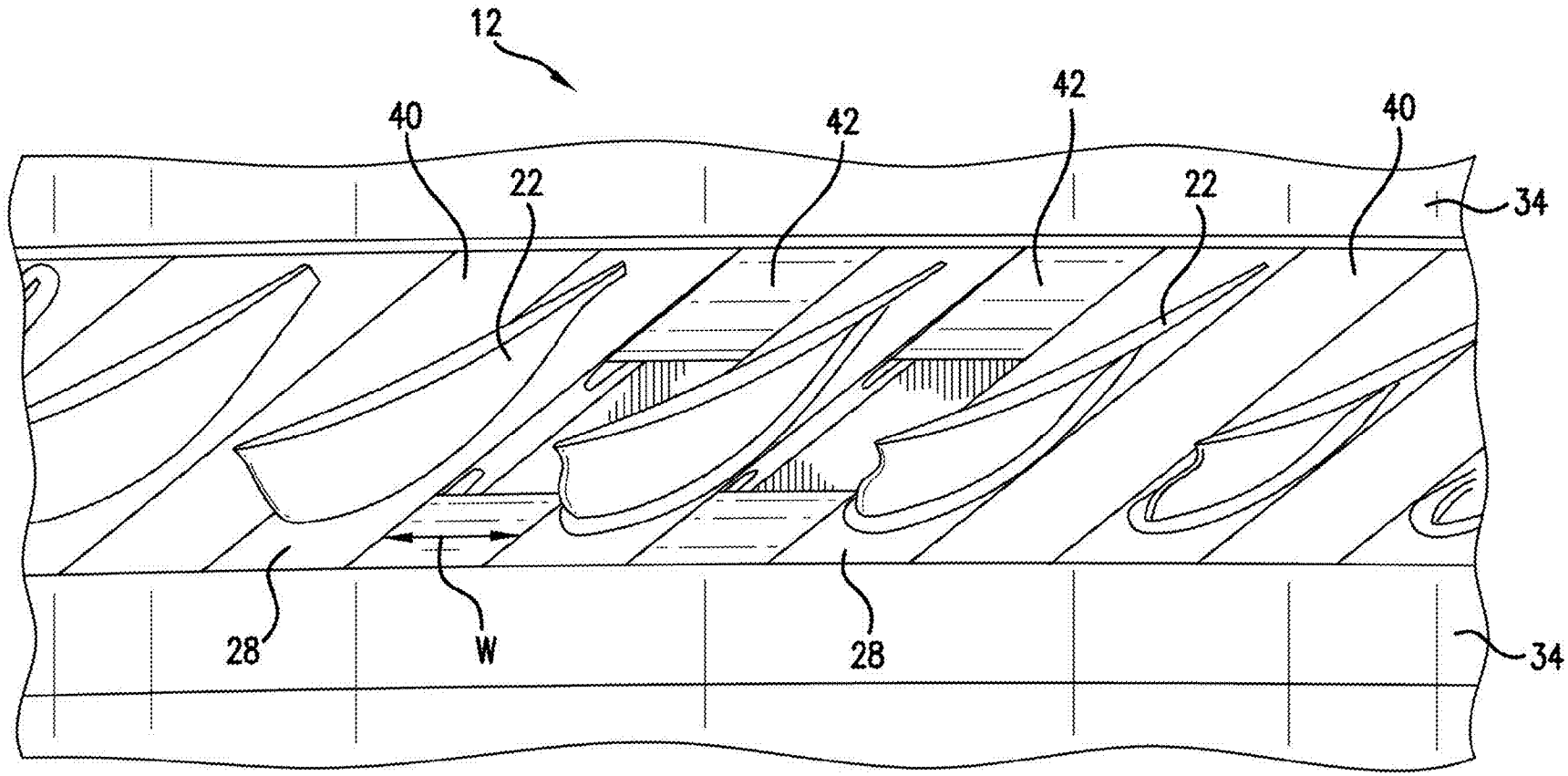
FIG. 3 is a partial perspective view of a rotor disc with final spaces between adjacent rotor blade platforms into which a locking spacer assembly may be inserted.

FIG. 3 is a partial perspective view of a portion of a rotor 12, and particularly illustrates a plurality of rotor blades 22 configured in an attachment slot between forward and aft post components 34 of the rotor disc 20. Each of the rotor blades 22 includes a platform 28. Conventional spacers 40 may be disposed between the platforms 28 of adjacent blades 22, as is generally known in the art. Final spaces 42, having a horizontal width W between the rotor blade platforms 28, can be filled by an embodiment of the locking spacer assembly 50, which is described in greater detail below. However, it should be appreciated that the locking spacer assembly 50 can also be used to fill the final spaces between platforms of adjacent turbine buckets located within the turbine section of a conventional gas turbine. As such, the locking spacer assembly will be generally described below as being installed between platforms 28 of adjacent airfoils 26, wherein the platforms 28 and airfoils 26 may be part of a rotor blade or a turbine bucket so as to fully encompass both applications.

Figure 4:
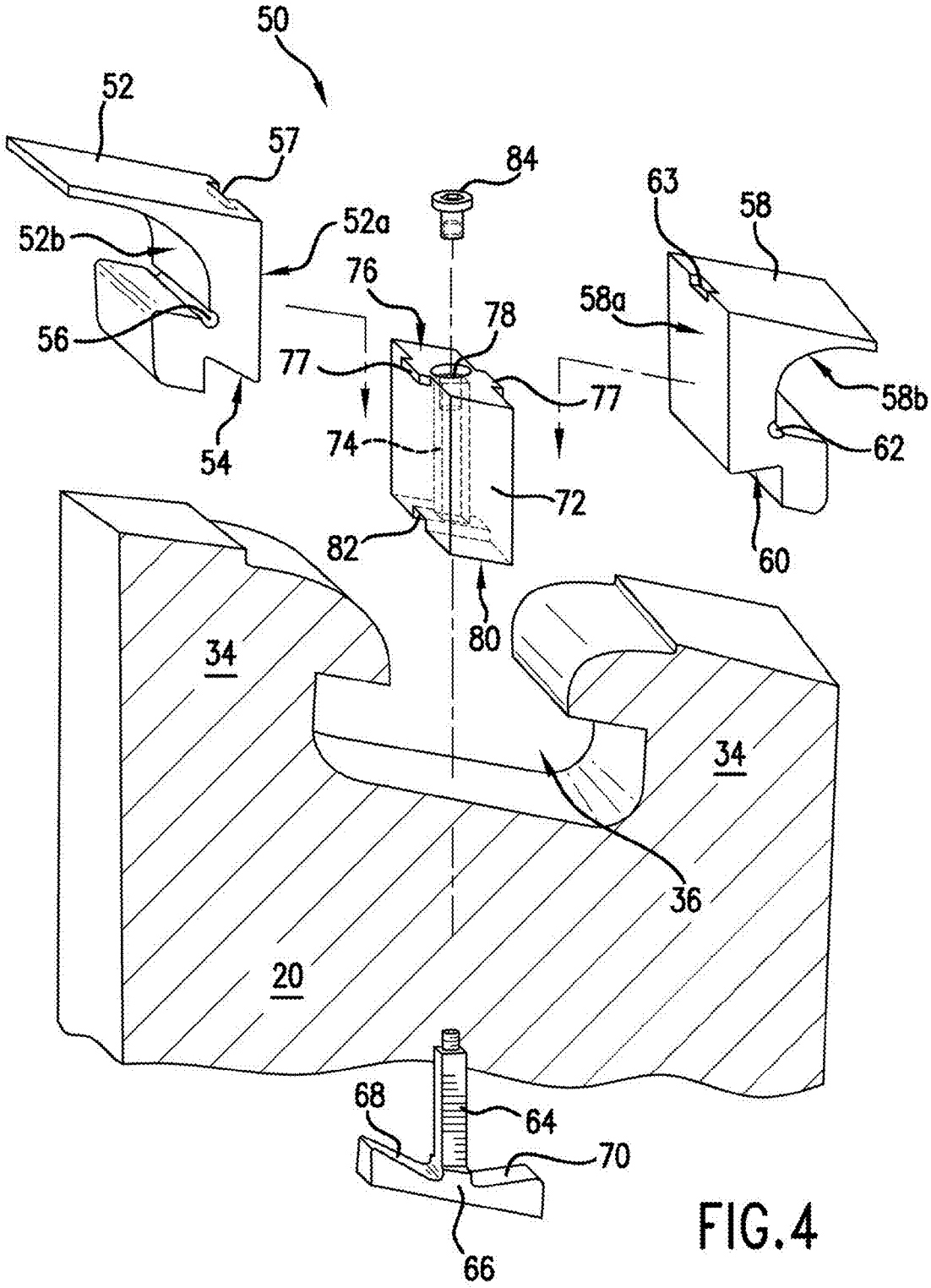
FIG. 4 is an exploded view of the components of an embodiment of the locking spacer assembly in accordance with aspects of the present subject matter.

Referring to FIG. 4, an embodiment of the locking spacer assembly 50 is illustrated in an exploded view. The assembly 50 includes a first end piece 52 and a second end piece 58 configured to fit into the final spaces 42 between platforms 28 of adjacent airfoils 26. The end pieces 52, 58, thus, have any dimensional configuration such that the width, length, thickness, or any other characteristics enables the end pieces 52, 58 to be inserted between the platforms 28. For example, the end pieces 52, 58 may generally have a horizontal width W (FIG. 3) in order to fit snugly between the platforms 28 of adjacent airfoils.

Figure 5:
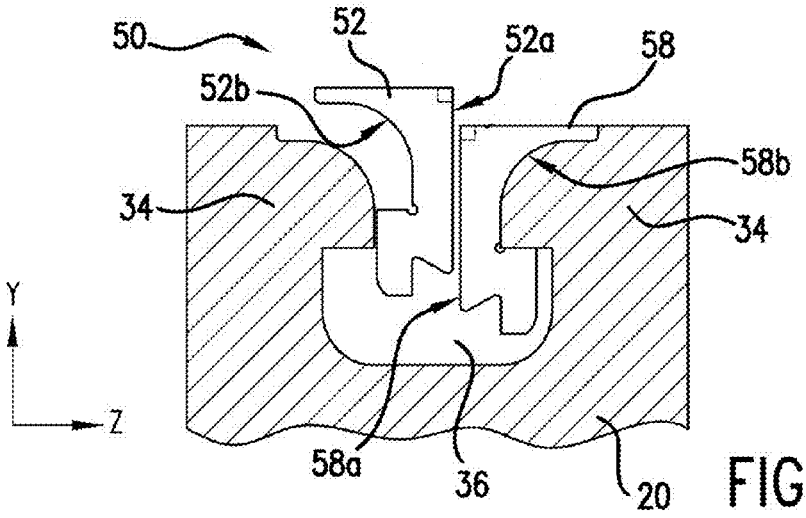
FIG. 5, FIG. 6, FIG. 7, and FIG. 8 are sequential assembly views of an embodiment of a locking spacer assembly in accordance with aspects of the present subject matter.

The first end piece 52 includes an inner surface 52*a* and an outer surface 52*b*. Similarly, the second end piece 58 includes an inner surface 58*a* and an outer surface 58*b*. Outer surfaces 52*b*, 58*b* have a profile generally adapted to project into the attachment slot 36, as generally illustrated in FIG. 5. For example, the profile of the outer surfaces 52*b*, 58*b* may have a top portion that is substantially curved to mirror the curve of the post components 34. Moreover, the profile may have a bottom portion that extends outwardly at the corner formed between the hoop components 34 and the lateral recesses 38 to project into the illustrated t-type attachment slot 36. However, it should be readily appreciated that outer surfaces 52*b*, 58*b* can have any desired profile and need not have the particular profile illustrated in FIG. 4 and FIG. 5. The profile of outer surfaces 52*b*, 58*b* will depend in large part on the particular shape and configuration of the attachment slot 36.

It may also be desirable to provide arcuate grooves 56, 62 on the outer surfaces 52*b*, 58*b*, respectively. For example, the arcuate grooves 56, 62 may be included to provide a point of low stress or a location for stress relief on the end pieces 52, 58. As illustrated, the arcuate grooves 56, 62 are located on the outer surfaces 52*b*, 58*b* at the corner formed between the hoop components 34 and the lateral recesses 38.

Figure 6:
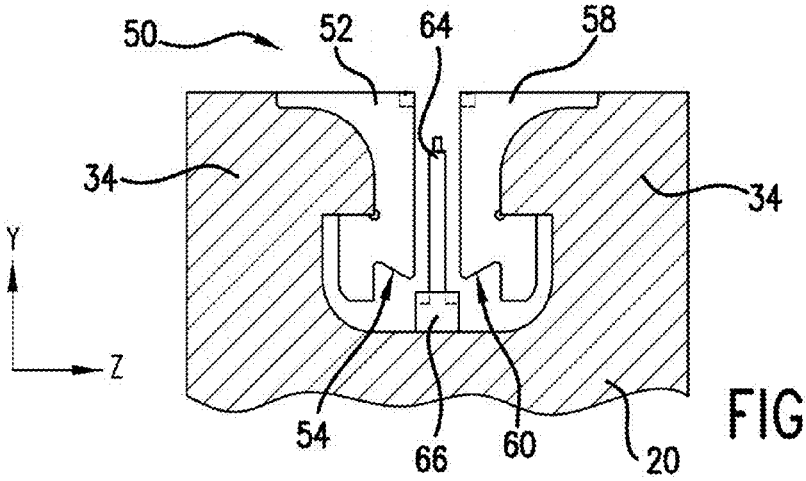
Figure 7:
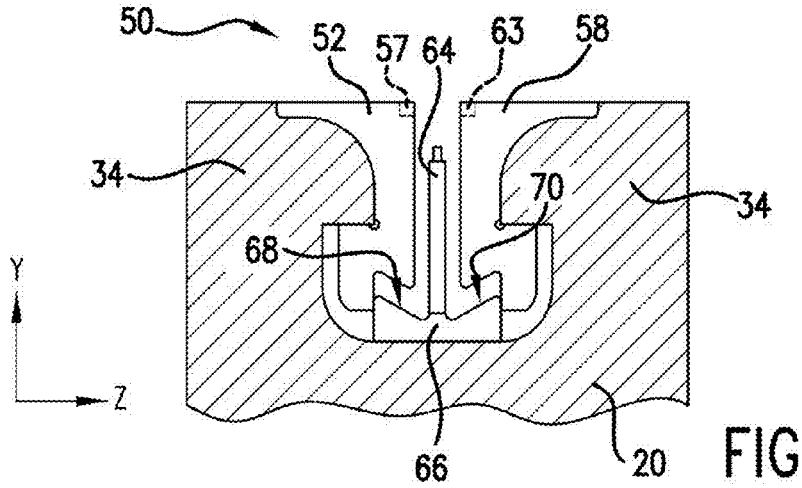

In the illustrated embodiment, the inner surfaces 52*a*, 58*a* generally face towards each other when the end pieces 52, 58 are inserted into the attachment slot 36, as is generally illustrated in FIG. 6. Preferably, planes 54, 60 form part of an indentation in the inner surfaces 52*a*, 58*a*, respectively and are defined by an angle relative to radial. It should be appreciated that the angles and locations of planes 54, 60 on inner surfaces 52*a*, 58*a* can be varied depending on the configuration of the actuator 64. In general, the angle of planes 54, 60 can range between 5° and 85°, such as from 20° to 70° or, more specifically, from 30° to 50°.

Additionally, rectangular recesses 57, 63 may be formed on the inner surfaces 52*a*, 58*a*, respectively. As illustrated in FIG. 4, the rectangular recesses 57, 63 are formed in the inner surfaces 52*a*, 58*a* at the top of the end pieces 52, 58. The rectangular recesses 57, 63 may be configured to receive complimentary rectangular collars 77 of the spacer bock, as will be discussed below. Thus, it should be appreciated that the shape, depth, and location of the rectangular recesses 57, 63 may vary depending on the configurations of the complimentary rectangular collars 77.

The locking spacer assembly 50 also includes an actuator 64 movable between the inner surfaces 52*a*, 58*a* and configured to engage such inner surfaces 52*a*, 58*a*. Preferably, the actuator 64 includes a projection 66 configured to engage the inner surfaces 52*a*, 58*a*. In the illustrated embodiment, the projection 66 extends outward from the base of the actuator 64 in opposing directions such that the actuator is T-shaped. The projection 66 may include angled surfaces 68, 70, which are defined by an angle relative to radial. Generally, the angled surfaces 68, 70 may have a shape and angle that conforms to the shape and angles of the planes 54, 60 forming part of the indentation in the inner surfaces 52*a*, 58*a*.

Figure 8:
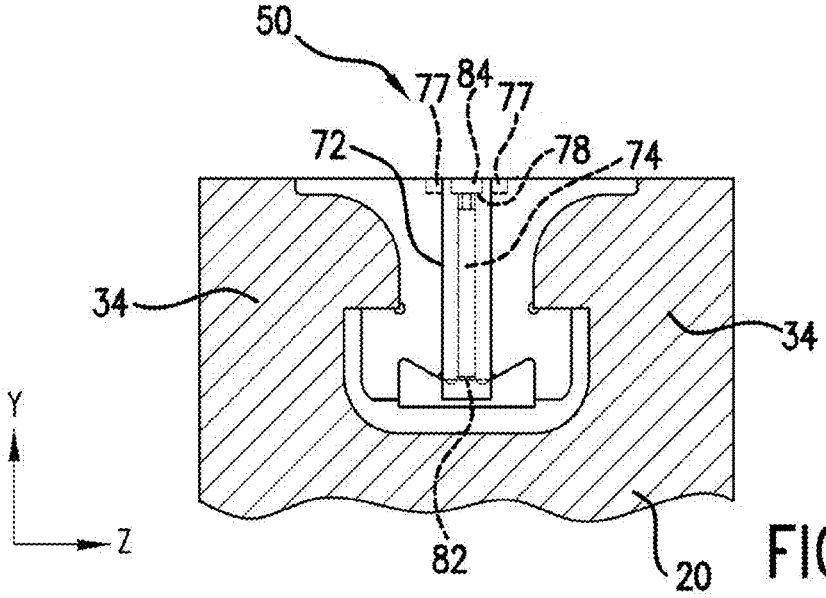
Figure 9:
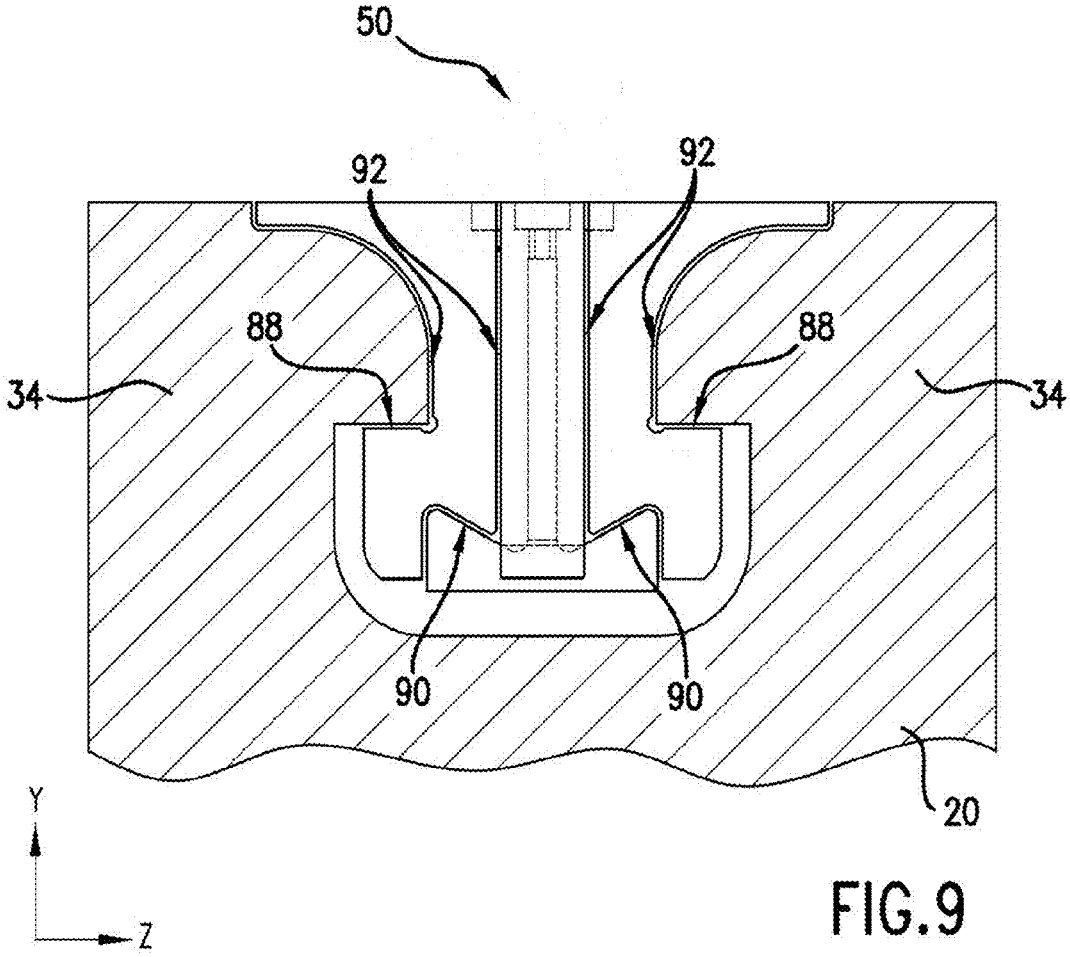
FIG. 9 is a sectional view of an assembled embodiment of a locking spacer assembly in accordance with aspects of the present subject matter indicating the locations of rotational loading.

Referring to FIG. 4, FIG. 8 and FIG. 9, the locking spacer assembly also includes a spacer block 72 and a fastener 84. As illustrated, the spacer block 72 is configured to be inserted between the inner surfaces 52*a*, 58*a* and includes a cavity 74 (shown by hidden lines in FIG. 4 and FIG. 8) configured to receive the actuator 64. Similar to the end pieces 52, 58, the spacer block 72 is also configured to fit between the platforms 28 of adjacent airfoils 26. Thus, the spacer block 72 may have any dimensional configuration such that the width, length, thickness, or any other characteristic enables the spacer block 72 to be inserted between the platforms 28 when disposed between inner surfaces 52*a*, 58*a*. For example, the spacer block 72 may generally have a horizontal width W (FIG. 3) in order to fit snugly between the platforms 28.

The spacer block 72 may also include rectangular collars 77 extending laterally from the top of the spacer block 72. The rectangular collars 77 may be configured to be received in the rectangular recesses 57, 63 formed in the inner surfaces 52*a*, 58*a*. As illustrated in FIG. 8, the rectangular collars 77 slide into the rectangular recesses 57, 63 when the spacer block 72 is inserted between the inner surfaces 52*a*, 58*a*, which can prevent the spacer block 72 from falling radially down in the attachment slot 36.

The spacer block 72 may also include an opening 78 and a rectangular channel 82. The opening 78 is defined in a top surface 76 of the spacer block 72 and is configured to receive the fastener 84. For example, the fastener 84 may fit into opening 78 such that the fastener 84 is positioned generally flush with the platforms 28 when the locking spacer assembly 50 is locked within the attachment slot 36. The rectangular channel 82 is defined in a bottom surface 80 of the spacer block 72 and is configured to receive a portion of the actuator 64. Specifically, as illustrated in FIG. 8, the rectangular channel 82 slides over a portion of the projection 66 when locking spacer assembly 50 is assembled. It should be appreciated, however, that the opening 78 and rectangular channel 82 need not have the particular shape, depth or width as is generally illustrated. The shape, width and depth of the opening and rectangular channel may be varied to accommodate varying shapes and sizes of fasteners and actuators.

The fastener 84 is configured to secure the spacer block 72 to the actuator 64. Thus, the fastener 84 can be used to prevent the actuator 64 from falling radially down into the attachment slot 36. It should be appreciated by one of ordinary skill in the art that the fastener 84 may generally comprise any locking mechanism that may be used to secure the spacer block 72 to the actuator 64. In the illustrated embodiment, the fastener 84 has a threaded female end which can be screwed onto a threaded male end of the actuator 64.

FIG. 5, FIG. 6, FIG. 7 and FIG. 8 illustrate sequential assembly views of one embodiment of the locking spacer assembly 50. Initially, the end pieces 52, 58 may be inserted into the attachment slot 36 and spaced apart such that the actuator 64 can be inserted between the inner surfaces 52*a*, 58*a*. Once inserted between the inner surfaces 52*a*, 58*a*, the actuator 64 is rotated ninety degrees so that the angled surfaces 68, 70 of the projection 66 generally face the angled planes 54, 60 of the inner surfaces 52*a*, 58*a*. The spacer block 72 can then be inserted between the inner surfaces 52*a*, 58*a*, with the rectangular collars 77 of the spacer block 72 being received into the complimentary rectangular recesses 57, 63 of the inner surfaces 52*a*, 58*a*. The actuator 64 is then pulled radially outward (in direction Y) by hand until the angled surfaces 68, 70 engage the angled planes 54, 60 causing the end pieces 52, 58 to move toward each other and lock the assembly 50 together within the attachment slot 36. The fastener 84 may then be applied to secure the actuator 64 to the spacer block 74 and prevent the actuator 64 from falling radially down.

Upon installation of the fastener 84, the locking spacer assembly 50 remains locked together within the attachment slot 36, albeit in a somewhat loose state. However, as the rotor disc 20 rotates during operation of the turbine engine, rotational loading on the assembly components cause the assembly 50 to lock together tightly within the attachment slot 36. Specifically, the radial load on the actuator 64 caused by rotation of the rotor disc 20 is transferred through the end pieces 52, 58 to the rotor disc 20 to tightly lock the assembly within the attachment slot 36.

FIG. 9 illustrates the locations of rotational loading on the various components of the locking spacer assembly 50 during operation of a conventional gas turbine. Upon rotation of the rotor disc 20, end pieces 52, 58 load radially (in direction Y) on the post components 34 of the disc 20 at post locations 88. Simultaneously, rotation of the rotor disc 20 causes rotational loading on the spacer block 72, which is transmitted through the fastener 84 to the actuator 64. Due to the rotational loading resulting from centrifugal forces, the actuator 64 moves radially outward engaging the end pieces 52, 58 at the projection locations 90. Since the projection locations 90 are at an angle relative to radial, there is a component of the radial load which causes the end pieces 52, 58 to move towards each other, locking the assembly 50 tightly within the attachment slot 36.

As illustrated in FIG. 9, the components of the locking spacer assembly 50, once assembled, may have tolerance. However, it is desirable to have each component fit snugly within the attachment slot 36 such that the components of the locking spacer assembly 50 substantially fill the width of the attachment slot 36 between the post components 34. For example, tight tolerances, resulting in a snug fit at the tolerance locations 92, will ensure that only a minimal amount of translation is required for the end pieces 52, 58 to lock the locking spacer assembly 50 together within the attachment slot 36. Additionally, tight tolerances can prevent significant rotation of the locking spacer assembly 50, thereby creating an anti-rotation feature.

It should be appreciated that the present subject matter also encompasses a rotor assembly 100 (FIG. 2) incorporating a locking spacer assembly 50 as described and embodied herein. The rotor assembly 100 includes a rotor 12 having a rotor disc 20 with forward and aft posts 34 defining a continuous circumferentially extending attachment slot 36. The rotor assembly also includes a plurality of airfoils 26, with each airfoil 26 extending from a platform 28. The platform 28 is secured within the attachment slot 36 by an inwardly extending root 30. At least one locking spacer assembly 50 in accordance with any of the embodiments illustrated or described herein is disposed in a space between two of the platforms 28. It should be readily appreciated, as indicated above, that the rotor assembly 100 may be disposed in the compressor or turbine section of a gas turbine, with the platforms 28 and airfoils 26 being part of a complete stage of either rotor blades or turbine buckets.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A locking spacer assembly for insertion into a circumferential attachment slot between platforms of adjacent airfoils, comprising:

a first end piece configured to fit into a space between platforms of adjacent airfoils, said first end piece comprising an outer surface and an inner surface, said outer surface having a profile adapted to project into an attachment slot;

a second end piece configured to fit into a space between said platforms, said second end piece comprising an outer surface and an inner surface, said outer surface having a profile adapted to project into said attachment slot, wherein said inner surfaces of said first and second end pieces generally face each other;

an actuator movable between said inner surfaces, said actuator including a projection configured to engage said first and second end pieces at projection locations located along a radially inner portion of said inner surfaces of said first and second end pieces;

a spacer block configured to be inserted between said inner surfaces, said spacer block defining a cavity configured to receive said actuator;

a fastener configured to secure said spacer block to said actuator; and wherein said actuator engages said inner surfaces such that said first and second end pieces move toward each other at said projection locations and lock said assembly within said attachment slot.

2. The locking spacer assembly of claim 1, wherein said radially inner portion corresponds to a lower half of each of said inner surfaces of said first and second end pieces.

3. The locking spacer assembly of claim 1, further comprising a first angled surface and a second angled surface formed on said projection at said projection locations, said angled surfaces defined by an angle relative to radial.

4. The locking spacer assembly of claim 3, further comprising a first angled plane formed on said inner surface of said first end piece and a second angled plane formed on said inner surface of said second end piece, wherein said first and second angled surfaces of said actuator are configured to engage said first and second angled planes at said projection locations.

5. The locking spacer assembly of claim 1, further comprising rectangular recesses formed on said inner surfaces of said first and second end pieces.

6. The locking spacer assembly of claim 5, wherein said spacer block further comprises rectangular collars, wherein said rectangular collars are configured to be received in said rectangular recesses when said spacer block is inserted between said inner surfaces.

7. The locking spacer assembly of claim 1, further comprising an opening defined in a top surface of said spacer block, wherein said opening is configured to receive said fastener.

8. The locking spacer assembly of claim 1, further comprising a channel defined in a bottom surface of said spacer block, wherein said channel is configured to receive a portion of said actuator.

9. The locking spacer assembly of claim 1, further comprising grooves defined on said outer surfaces of said first and second end pieces.

10. A rotor assembly, comprising:

a rotor having a rotor disc with forward and aft posts defining a continuous circumferentially extending attachment slot;

a plurality of airfoils, each of said plurality of airfoils extending from one of a plurality of platforms, wherein each of said plurality of platforms is secured to said attachment slot by an inwardly extending root;

a locking spacer assembly disposed in a space between at least two of said plurality of platforms, said locking spacer assembly further comprising:

a first end piece configured to fit into said space, said first end piece comprising an outer surface and an inner surface, said outer surface having a profile adapted to project into said attachment slot;

a second end piece configured to fit into said space, said second end piece comprising an outer surface and an inner surface, said outer surface having a profile adapted to project into said attachment slot, wherein said inner surfaces of said first and second end pieces generally face each other;

an actuator movable between said inner surfaces, said actuator including a projection configured to engage said first and second end pieces at projection locations located along a radially inner portion of said inner surfaces of said first and second end pieces;

a spacer block configured to be inserted between said inner surfaces, said spacer block defining a cavity configured to receive said actuator;

a fastener configured to secure said spacer block to said actuator; and wherein said actuator engages said inner surfaces such that said first and second end pieces move toward each other at said projection locations and lock said assembly within said attachment slot.

11. The rotor assembly of claim 10, wherein said radially inner portion corresponds to a lower half of each of said inner surfaces of said first and second end pieces.

12. The rotor assembly of claim 10, further comprising a first angled surface and a second angled surface formed on said projection at said projection locations, said angled surfaces defined by an angle relative to radial.

13. The rotor assembly of claim 12, further comprising a first angled plane formed on said inner surface of said first end piece and a second angled plane formed on said inner surface of said second end piece, wherein said first and second angled surfaces of said actuator are configured to engage said first and second angled planes at said projection locations.

14. The rotor assembly of claim 10, further comprising rectangular recesses formed on said inner surfaces of said first and second end pieces.

15. The rotor assembly of claim 14, wherein said spacer block further comprises rectangular collars, wherein said rectangular collars are configured to be received in said rectangular recesses when said spacer block is inserted between said inner surfaces.

16. The rotor assembly of claim 10, further comprising an opening defined in a top surface of said spacer block, wherein said opening is configured to receive said fastener.

17. The rotor assembly of claim 10, further comprising a channel defined in a bottom surface of said spacer block, wherein said channel is configured to receive a portion of said actuator.

18. The rotor assembly of claim 10, further comprising grooves defined on said outer surfaces of said first and second end pieces.

* * * * *